US009150992B2

(12) United States Patent
Tseng

(10) Patent No.: US 9,150,992 B2
(45) Date of Patent: Oct. 6, 2015

(54) SEWING MACHINE WITH A DRIVE-SELECTION DEVICE CAPABLE OF POSITIONING AN UPPER THREAD WIPER WHEN IN A NON-DRIVE POSITION

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 65 days.

(21) Appl. No.: 14/181,625

(22) Filed: Feb. 15, 2014

(65) Prior Publication Data

US 2015/0233034 A1 Aug. 20, 2015

(51) Int. Cl.

| | |
|---|---|
| ***D05B 57/34*** | (2006.01) |
| ***D05B 55/16*** | (2006.01) |
| ***D05B 69/22*** | (2006.01) |
| *D05B 57/06* | (2006.01) |

(52) U.S. Cl.

CPC ..... *D05B 55/16* (2013.01); *D05B 57/34* (2013.01); *D05B 69/22* (2013.01); *D05B 57/06* (2013.01)

(58) Field of Classification Search

CPC ..... D05B 57/00; D05B 57/02; D05B 57/06; D05B 57/30; D05B 57/32; D05B 57/34; D05B 1/10; D05B 55/16; D05B 69/22

USPC ..... 112/199, 200, 220

See application file for complete search history.

(56) References Cited

U.S. PATENT DOCUMENTS

| | | | | |
|---|---|---|---|---|
| 4,690,080 | A * | 9/1987 | Mikuni et al. | 112/162 |
| 5,237,942 | A * | 8/1993 | Satoma | 112/162 |
| 5,255,622 | A * | 10/1993 | Baba et al. | 112/162 |
| 5,732,639 | A * | 3/1998 | Kojima et al. | 112/162 |
| 7,458,326 | B2 * | 12/2008 | Yamaguchi et al. | 112/200 |
| 7,536,964 | B2 * | 5/2009 | Sadasue | 112/302 |

* cited by examiner

*Primary Examiner* — Ismael Izaguirre

(74) *Attorney, Agent, or Firm* — Patent Office of Bang Shia

(57) ABSTRACT

A sewing machine with a drive-selection device capable of positioning an upper thread wiper when in a non-drive position, the drive-selection device includes a moving member movably disposed on the pivot, an actuator for moving the moving member, and a pulling member for moving the actuator. The actuator is pivoted to the base and has one end provided with an actuating end, at the actuating end is provided an actuating protrusion which engages with and moves the actuating portion, another end of the actuator is formed with an engaging portion which is pushed against by the pulling member. The pulling member is pivoted to the base and has one side provided with a push portion which protrudes toward the engaging portion, and the pulling member is further provided with a fixing portion. An elastic member is disposed between the fixing portion and the actuating portion.

5 Claims, 12 Drawing Sheets

SEWING MACHINE WITH A DRIVE-SELECTION DEVICE CAPABLE OF POSITIONING AN UPPER THREAD WIPER WHEN IN A NON-DRIVE POSITION

BACKGROUND OF THE INVENTION

1. Field of the Invention

The present invention relates to a sewing machine, and more particularly to a sewing machine with a drive-selection device capable of positioning an upper thread wiper when in a non-drive position.

2. Description of the Prior Art

A sewing machine is normally provided with a drive device which is used to move needles and used in combination with a first wiper arm for moving an upper thread wiper, a second wiper arm for moving a lower thread wiper, and a presser foot on a needle plate, to carry out different sewing operations.

As shown in FIGS. 1 and 2, the sewing machine can be switched between a drive state where the first wiper arm 11 can be driven to move, and a non-drive state where the first wiper arm 11 cannot be driven to move. In the drive state, the upper thread wiper 12 is preferably located below the needle plate 13 so as to prevent the needles 14 from interfering with the upper thread wiper 12. However, the conventional sewing machine as shown is only capable of switching the first wiper arm 11 between the drive and non-drive states, without being able to making the upper thread wiper 12 located below the needle plate 13 when the first wiper arm 11 is in the non-drive state.

The present invention has arisen to mitigate and/or obviate the afore-described disadvantages.

SUMMARY OF THE INVENTION

The primary objective of the present invention is to provide a sewing machine with a drive-selection device capable of positioning an upper thread wiper when in a non-drive position.

To achieve the above objective, a sewing machine with a drive-selection device capable of positioning an upper thread wiper when in a non-drive position in accordance with the present invention is provided. A base of the sewing machine is provided with a mainshaft to move a wiper arm which includes an upper thread wiper, the wiper arm further includes an oscillating member pivoted to a pivot which is fixed to the base, to the pivot is further pivoted a drive member, and one end of the drive member is moved back and forth by the mainshaft, the drive-selection device is provided on the base to selectively switch the drive member between a drive position and non-drive with respect to the oscillating member.

The drive-selection device includes a moving member movably disposed on the pivot, an actuator for moving the moving member, and a pulling member for moving the actuator.

The moving member has one end provided with the pin which extends into an insertion portion of the drive member, the oscillating member is formed with an engaging hole, and the moving member is provided with an actuating portion The actuator is pivoted to the base and has one end provided with an actuating end, at the actuating end is provided an actuating protrusion which engages with and moves the actuating portion, another end of the actuator is formed with an engaging portion which is pushed against by the pulling member.

The pulling member is pivoted to the base and has one side provided with a push portion which protrudes toward the engaging portion, and the pulling member is further provided with a fixing portion.

An elastic member has one end fixed to the fixing portion and another end fixed to the actuating portion of the actuating end, so as to produce a prestress to pull the fixing portion and the actuating end toward each other.

The oscillating member is provided with a stop portion.

When the stop portion is aligned with the engaging portion, the pulling member is pulled toward the oscillating member to make the push portion push against the engaging portion, so that the engaging portion is engaged with the stop portion to fix the oscillating member, and the drive-selection device is in a non-drive position.

Preferably, one end of the drive member is driven to move by the mainshaft via a connecting member, the drive member is formed with a pivot hole for insertion of the pivot, and another end of the drive member is formed with the insertion portion for insertion of a pin.

Preferably, the oscillating member is provided in a center thereof with a pivot hole for insertion of the pivot, and has one end pivoted to the wiper arm, an oscillating disc which is provided with the engaging hole and the stop portion is fixed to another end of the oscillating member by a bolt, at the center of the oscillating disc is provided an insertion hole for insertion of the pivot, and the oscillating disc is further provided with an elongated adjustment hole for insertion of the bolt, so that the angle of the oscillating disc is allowed to be adjusted and fixed.

Preferably, the actuating portion is an annular groove formed around the outer peripheral surface of the moving member, a pivot portion extends out of the moving member, and the pin is provided on the pivot portion and extends toward the drive member.

Preferably, when the pulling member is pulled to move the push portion away from the engaging portion, the actuating end of the actuator is pulled by the elastic member to make the moving member move toward the drive member, and the pin on the moving member is provided with a prestress pulling the pin toward the oscillating member, when the mainshaft drives the drove member to rotate to a position where the insertion portion is aligned with the engaging hole of the oscillating disc, the pin will be engaged in the engaging hole to drive the oscillating member and the wiper arm to move, and the drive-selection device is in a drive position.

DETAILED DESCRIPTION OF THE PREFERRED EMBODIMENTS

Figure 1:
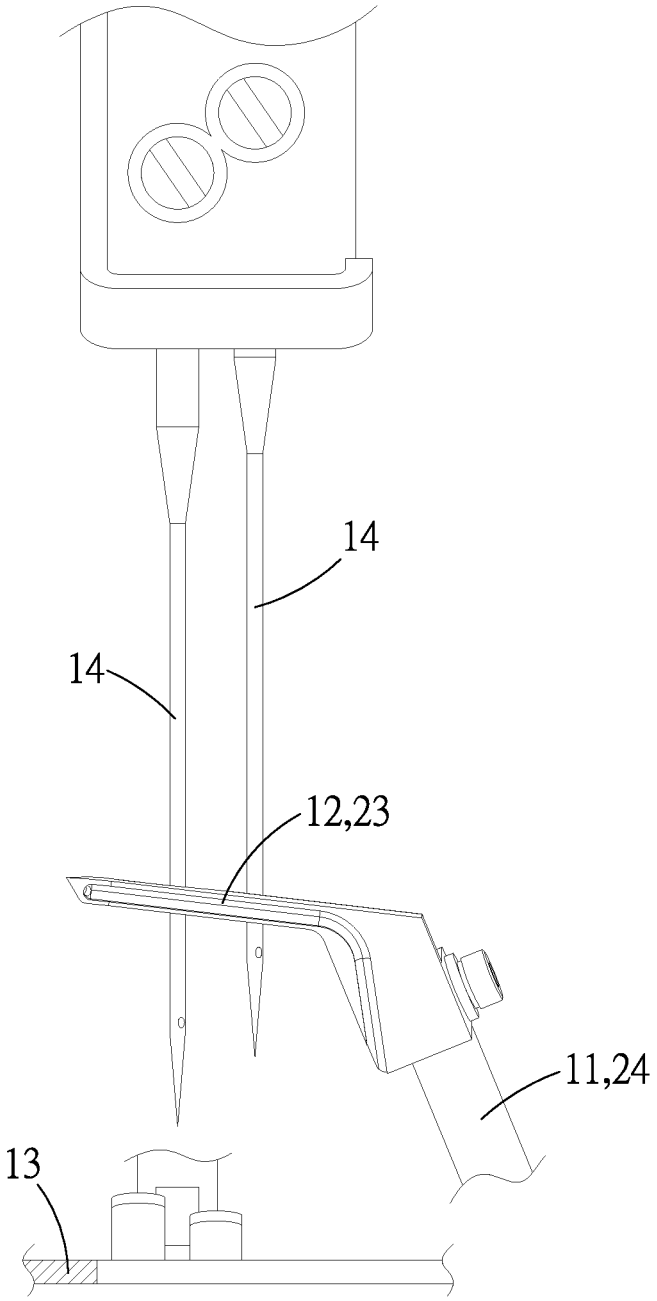
FIG.1 PRIOR ART
FIG. 1 shows a conventional sewing machine, wherein the upper thread wiper is located above the needle plate.

The present invention will be clearer from the following description when viewed together with the accompanying drawings, which show, for purpose of illustrations only, the preferred embodiment in accordance with the present invention.

Referring to FIGS. 3-8, a sewing machine with a drive-selection device 40 capable of positioning an upper thread wiper when in a non-drive position in accordance with the present invention is shown, wherein a base 21 of the sewing machine is provided with a mainshaft 22 to move a wiper arm 24 which includes an upper thread wiper 23. The wiper arm 24 further includes an oscillating member 31 pivoted to a pivot 32 which is fixed to the base 21. To the pivot 32 is further pivoted a drive member 33, and one end of the drive member 33 is moved back and forth by the mainshaft 22. The drive-selection device 40 is provided on the base 21 to selectively switch the drive member 33 between a drive position and non-drive with respect to the oscillating member 31. In this embodiment, one end 333 of the drive member 33 is driven to move by the mainshaft 22 via a connecting member 25. The drive member 33 is formed with a pivot hole 331 for insertion of the pivot 32, and another end of the drive member 33 is formed with an insertion portion 332 for insertion of a pin 34.

The drive-selection device 40 includes a moving member 41 movably disposed on the pivot 32, an actuator 42 for moving the moving member 41, and a pulling member 43 for moving the actuator 42.

The moving member 41 has one end provided with the pin 34 which extends into the insertion portion 332 of the drive member 33. The oscillating member 31 is formed with an engaging hole 35 for insertion of the pin 34, and the moving member 41 is provided with an actuating portion 411. In this embodiment, the actuating portion 411 is an annular groove formed around the outer peripheral surface of the moving member 41, a pivot portion 412 extends out of the moving member 41, and the pin 34 is provided on the pivot portion 412 and extends toward the drive member 33.

The actuator 42 is pivoted to the base 21 and has one end provided with an actuating end 421. At the actuating end 421 is provided an actuating protrusion 422 which engages in and moves the actuating portion 411. Another end of the actuator 42 is formed with an engaging portion 423 which is pushed against by the pulling member 43.

The pulling member 43 is pivoted to the base 21 and has one side provided with a push portion 431 which protrudes toward the engaging portion 423, and the pulling member 43 is further provided with a fixing portion 432.

An elastic member 44 has one end 441 fixed to the fixing portion 432 and another end fixed to the actuating protrusion 422 of the actuating end 421, so as to produce a prestress to pull the fixing portion 432 and the actuating end 421 toward each other.

Figure 12:
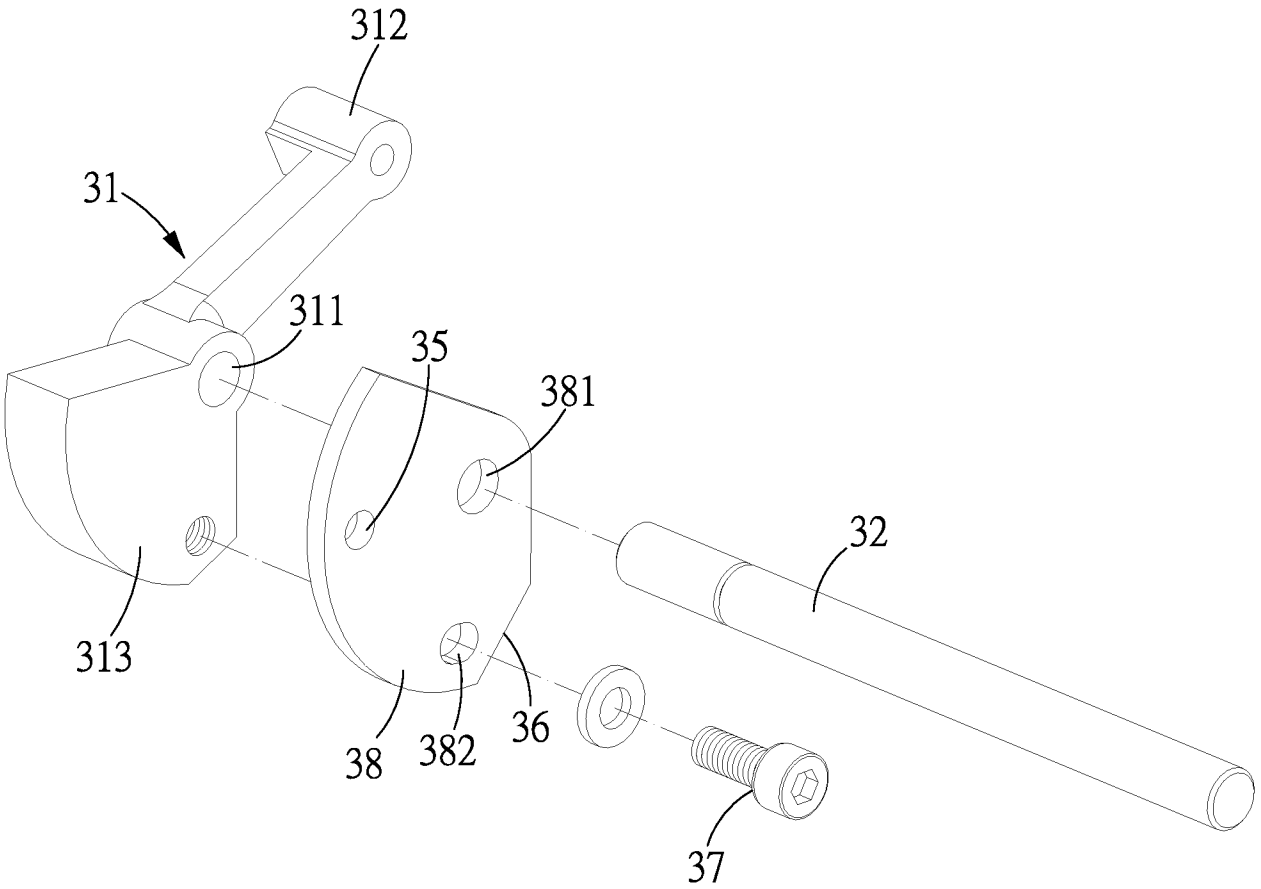
FIG. 12 is an exploded view of the oscillating member.

The oscillating member 31 is provided with a stop portion 36. In this embodiment, the oscillating member 31 is provided in the center thereof with a pivot hole 311 for insertion of the pivot 32, as shown in FIG. 12, and has one end 312 pivoted to the wiper arm 24. An oscillating disc 38 which is provided with the engaging hole 35 and the stop portion 36 is fixed to another end 313 of the oscillating member 31 by a bolt 37. At the center of the oscillating disc 38 is provided an insertion hole 381 for insertion of the pivot 32, and the oscillating disc 38 is further provided with an elongated adjustment hole 382 for insertion of the bolt 37, so that the angle of the oscillating disc 38 can be adjusted and fixed.

What mentioned above are the structures of the first preferred embodiment of the present invention, for a better understanding of the invention, its operating advantages and the specific objects attained by its uses, reference should be had to the following descriptive matter.

Figure 9:
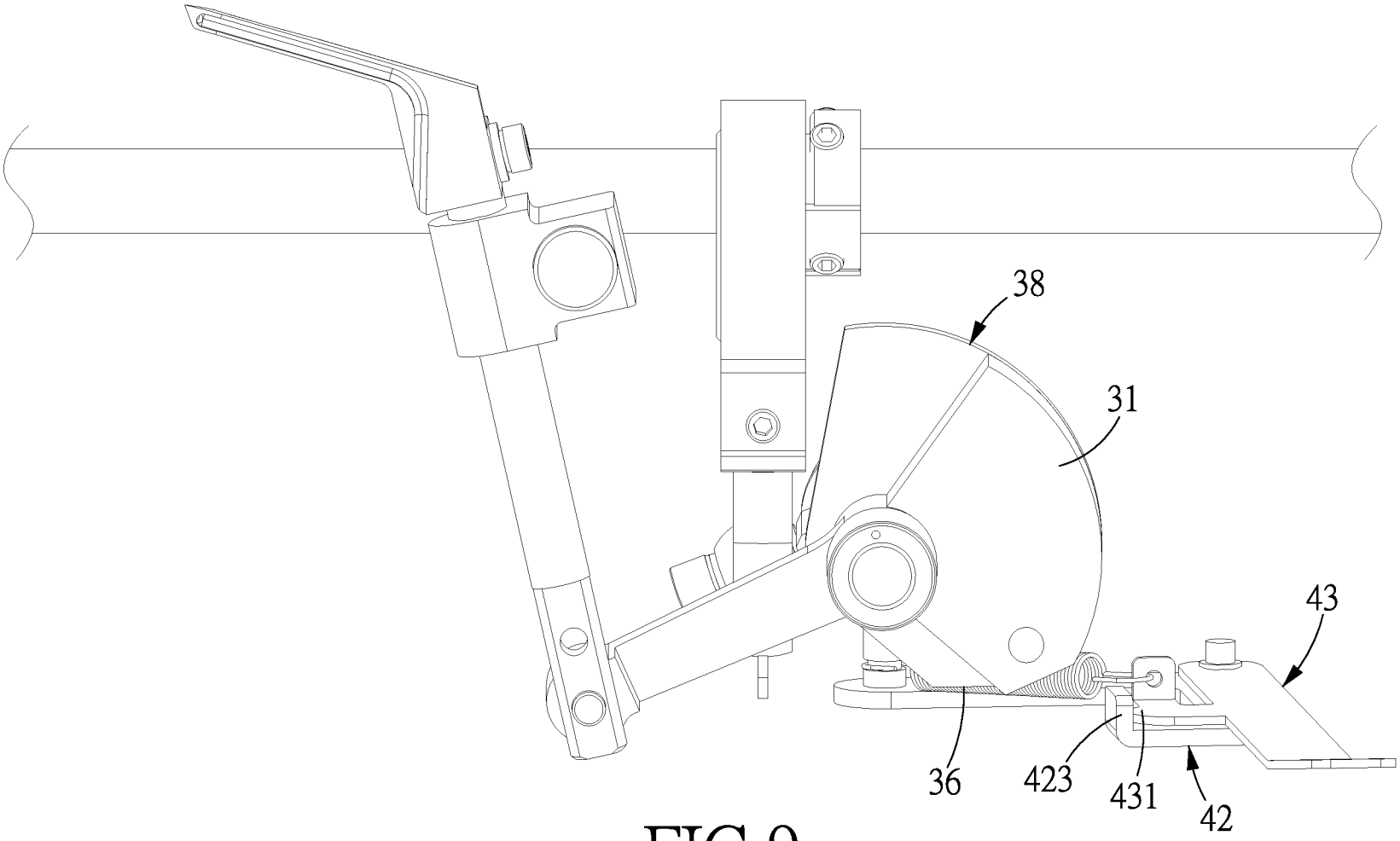
FIG. 9 is a side view of the sewing machine with a drive-selection device capable of positioning an upper thread wiper when in a non-drive position in accordance with the present invention, wherein the stop portion is aligned with the engaging portion.
Figure 10:
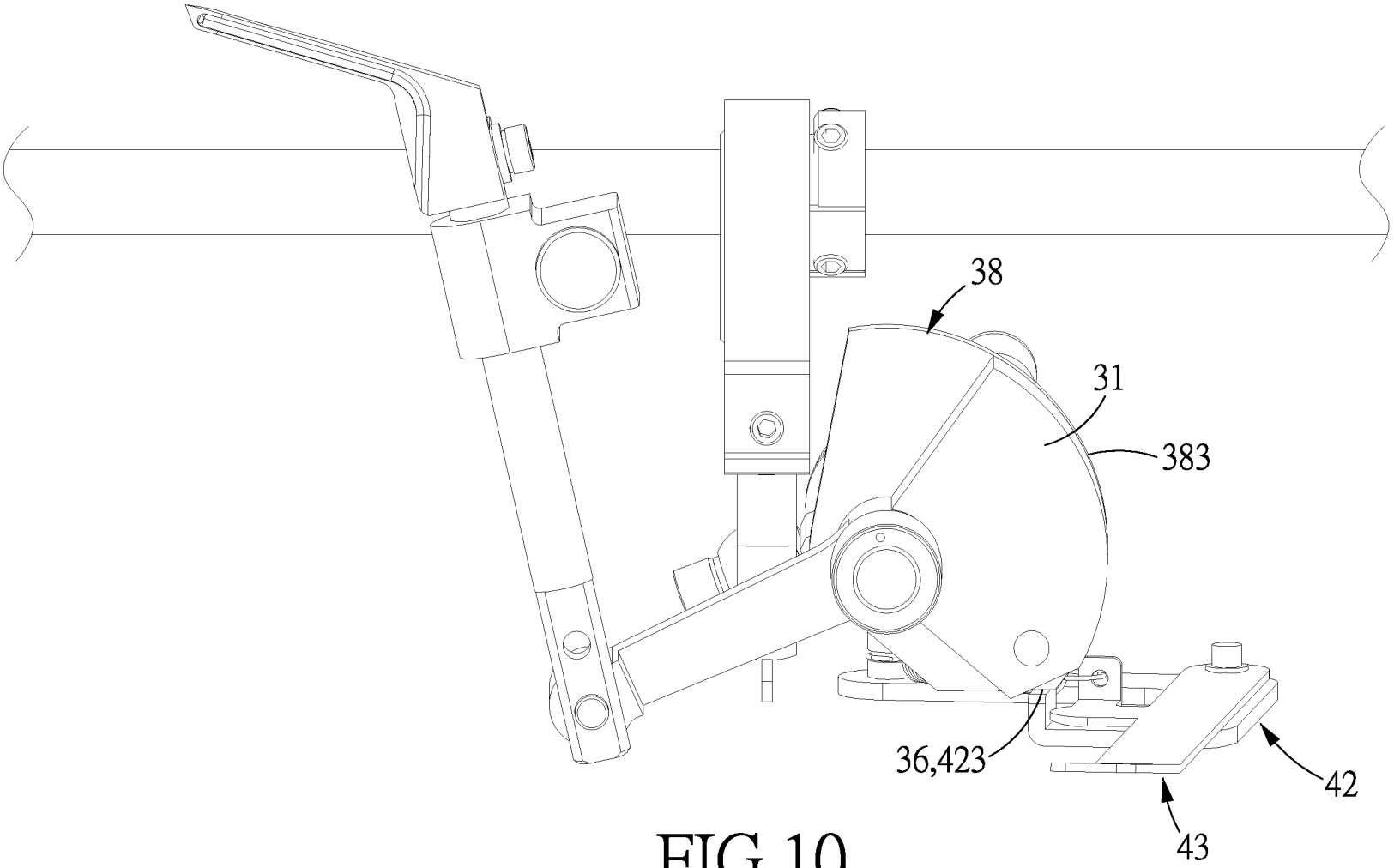
FIG. 10 is a side view of the sewing machine with a drive-selection device capable of positioning an upper thread wiper when in a non-drive position in accordance with the present invention, wherein the pulling member moves toward the oscillating member.
Figure 11:
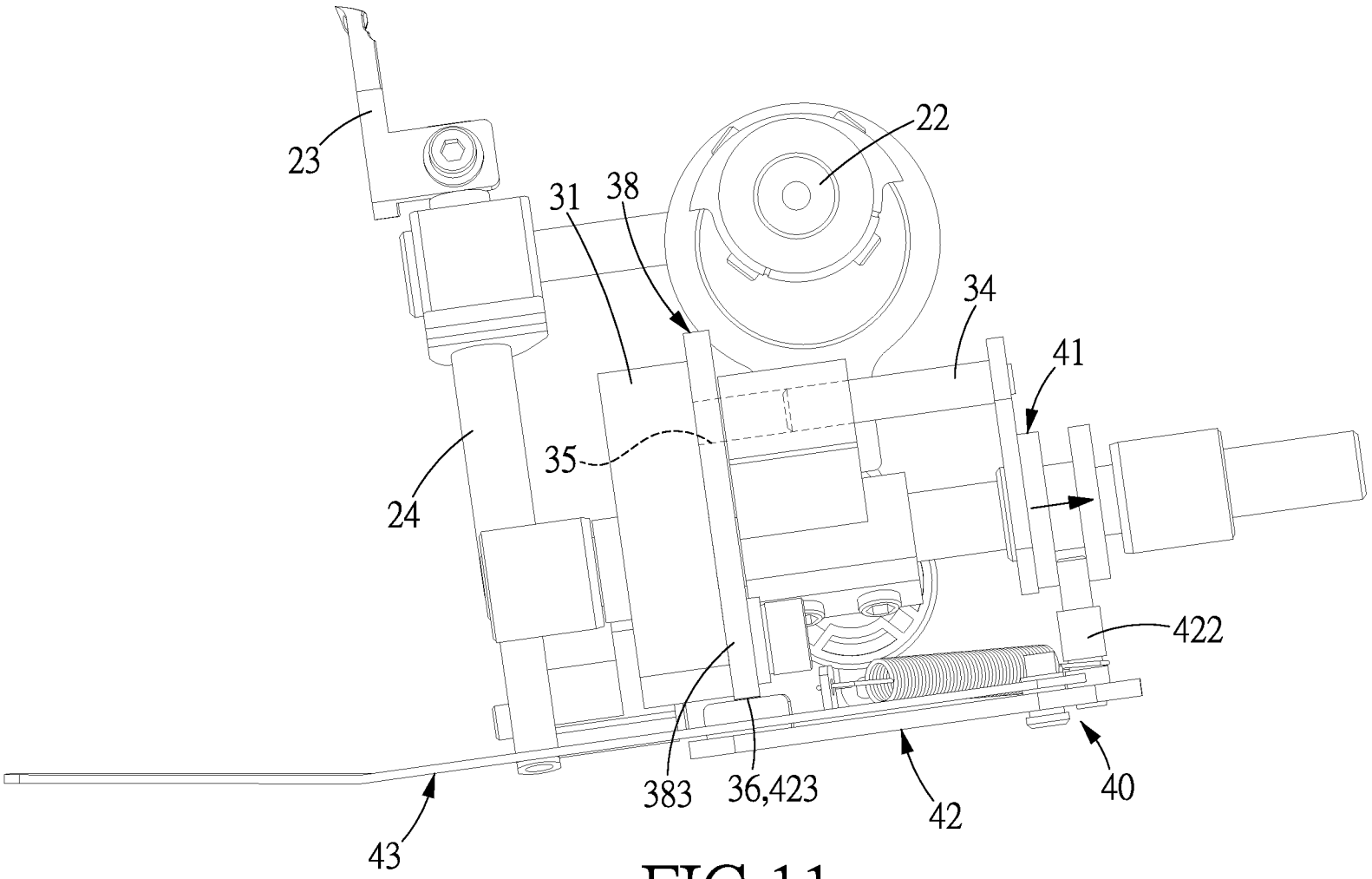
FIG. 11 is another side view of the sewing machine with a drive-selection device capable of positioning an upper thread wiper when in a non-drive position in accordance with the present invention, wherein the pulling member moves toward the oscillating member.

Referring to FIGS. 9-11, when the stop portion 36 of the oscillating disc 38 is aligned with the engaging portion 423 of the actuator 42, the pulling member 43 is pulled toward the oscillating member 31 to make the push portion 431 push against the engaging portion 423, so that the engaging portion 423 can be substantially engaged with the stop portion 36 to fix the oscillating member 31, at this moment, the drive-selection device 40 is in a non-drive position. It is to be noted that the non-drive position of the drive-selection device 40 means that, when the engaging portion 423 is moved toward the oscillating member 31 by the pulling member 43, the actuating protrusion 422 of the actuator 42 will also push the moving member 41 to move away from the oscillating member 31, to make the pin 34 disengage from the engaging hole 35 of the oscillating disc 38, so that the mainshaft 22 is unable to drive the oscillating member 31, the wiper arm 24 and the upper thread wiper 23 to move.

Figure 7:
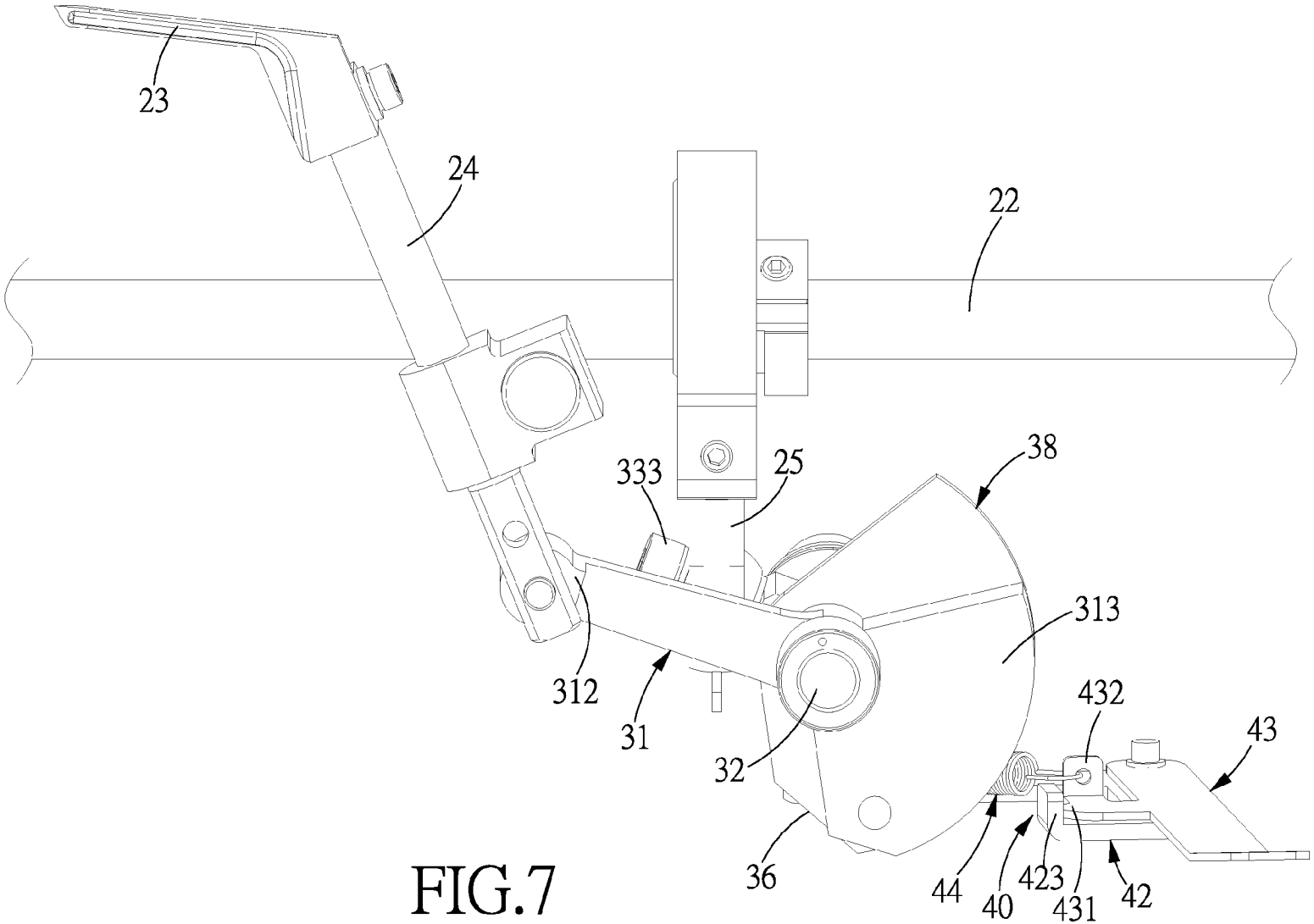
FIG. 7 is a side view of the sewing machine with a drive-selection device capable of positioning an upper thread wiper when in a non-drive position in accordance with the present invention.
Figure 8:
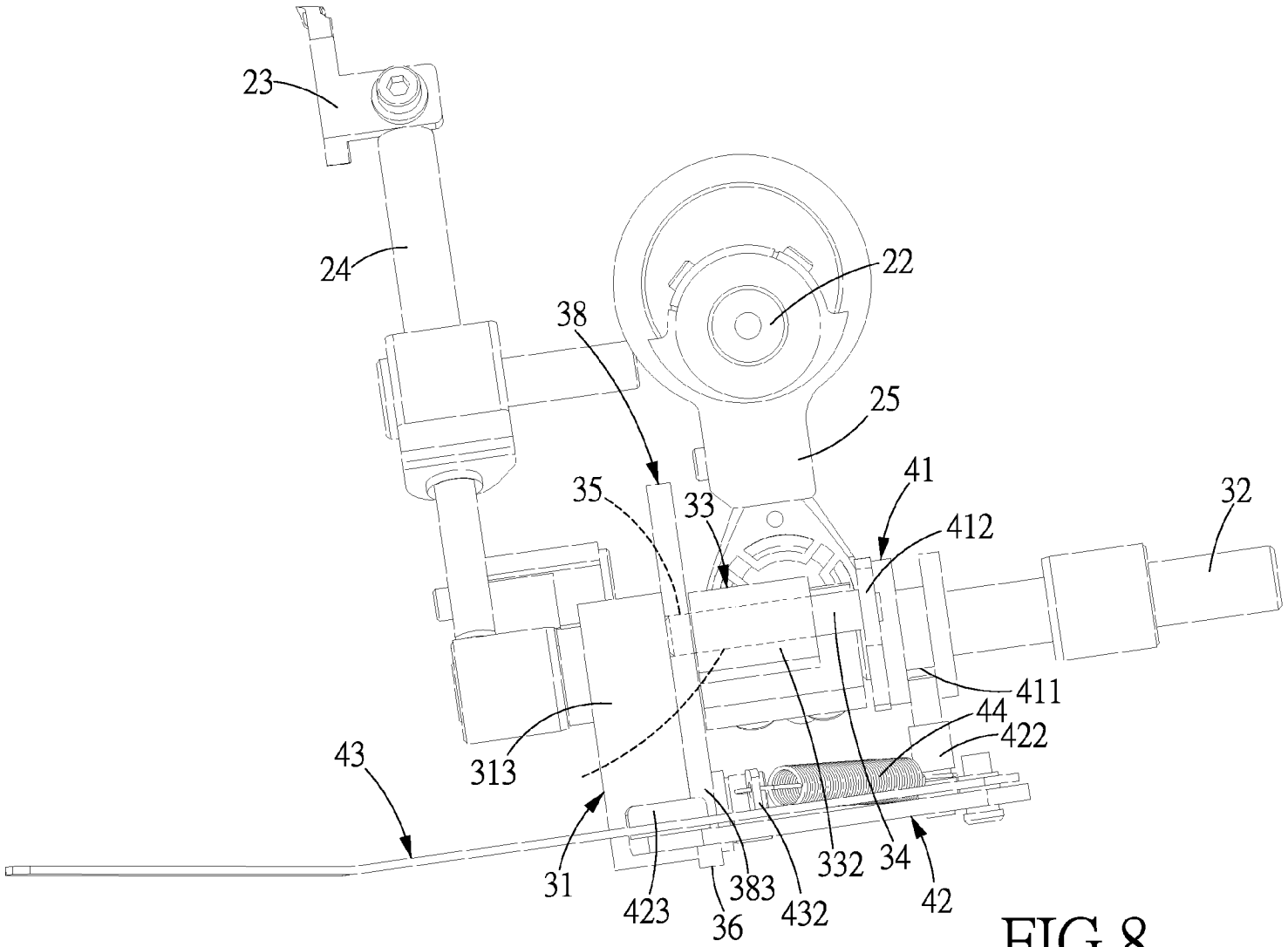
FIG. 8 is another side view of the sewing machine with a drive-selection device capable of positioning an upper thread wiper when in a non-drive position in accordance with the present invention.

Referring then to FIGS. 7 and 8, when the pulling member 43 is pulled to move the push portion 431 away from the engaging portion 423, the actuating end 421 of the actuator 42 is pulled by the elastic member 44 to make the moving member 41 move toward the drive member 33, and the pin 34 on the moving member 41 is provided with a prestress pulling the pin 34 toward the oscillating member 31. When the mainshaft 22 drives the drove member 33 to rotate to a position where the insertion portion 332 is aligned with the engaging hole 35 of the oscillating disc 38, the pin 34 will be engaged in the engaging hole 35 to drive the oscillating member 31 and the wiper arm 24 to move, and at this moment, the drive-selection device 40 is in a drive position.

Figure 2:
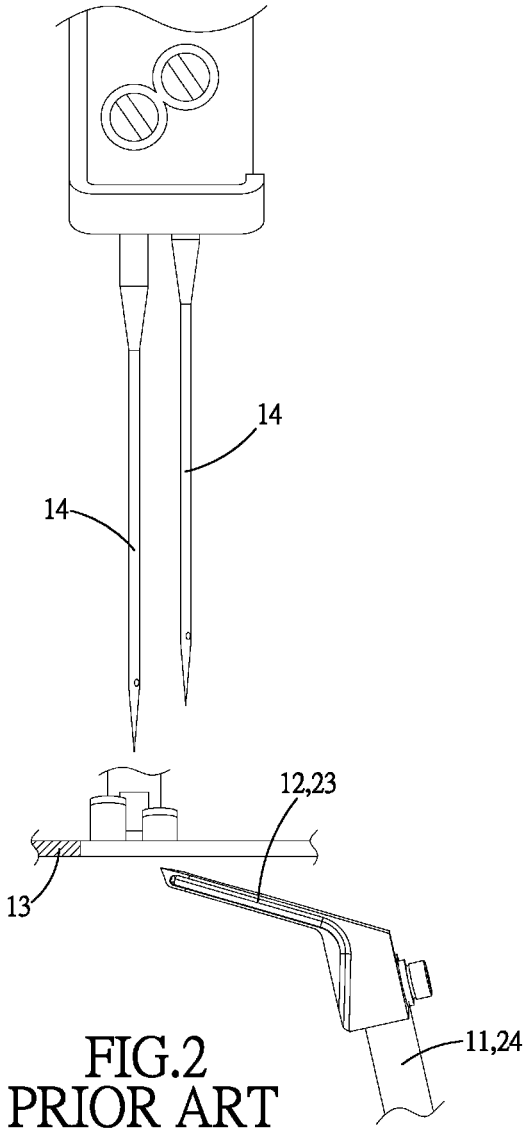
FIG.2 PRIOR ART
FIG. 2 shows a conventional sewing machine, wherein the upper thread wiper is located below the needle plate.
Figure 3:
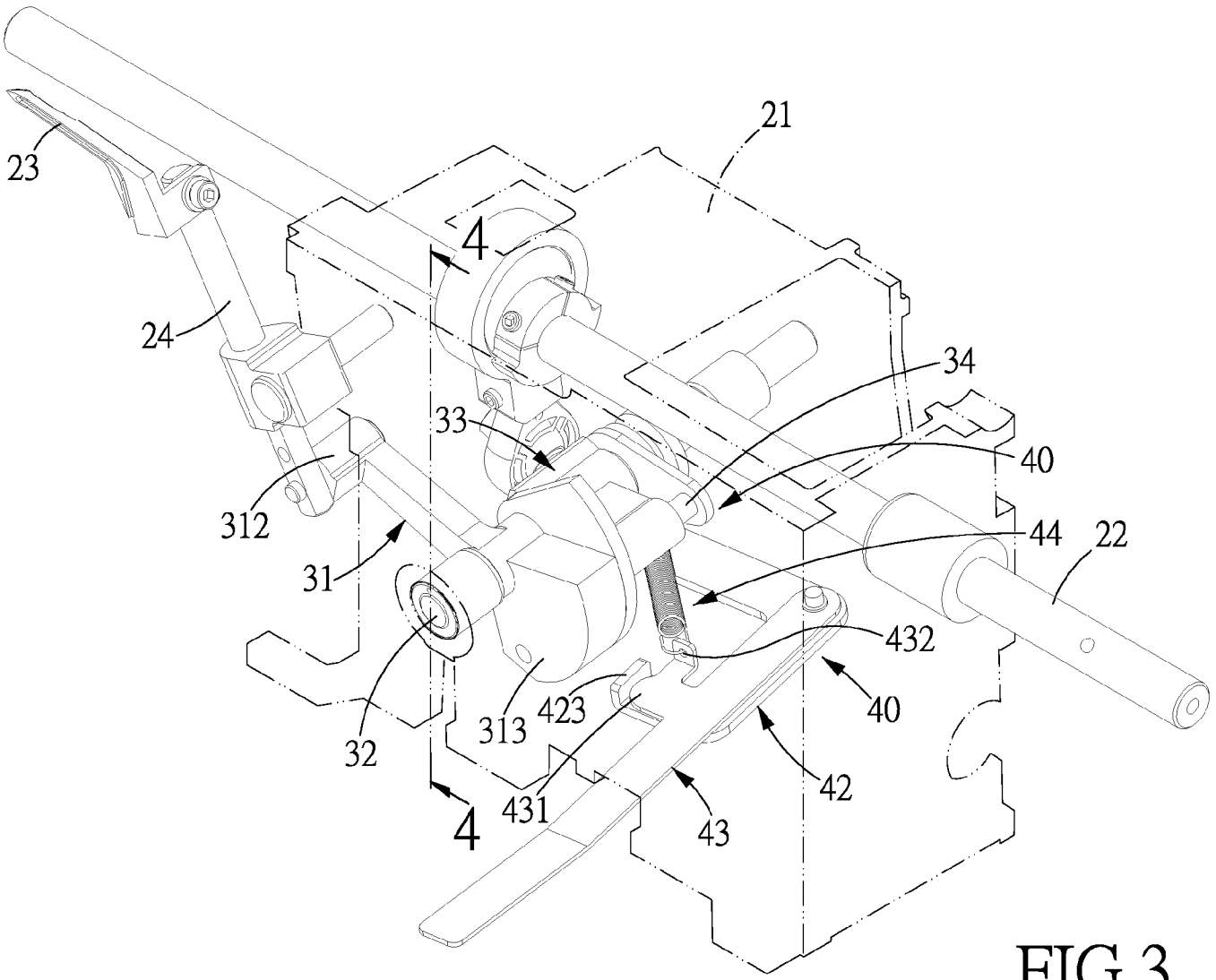
FIG. 3 is a perspective view of a sewing machine with a drive-selection device capable of positioning an upper thread wiper when in a non-drive position in accordance with the present invention.
Figure 4:
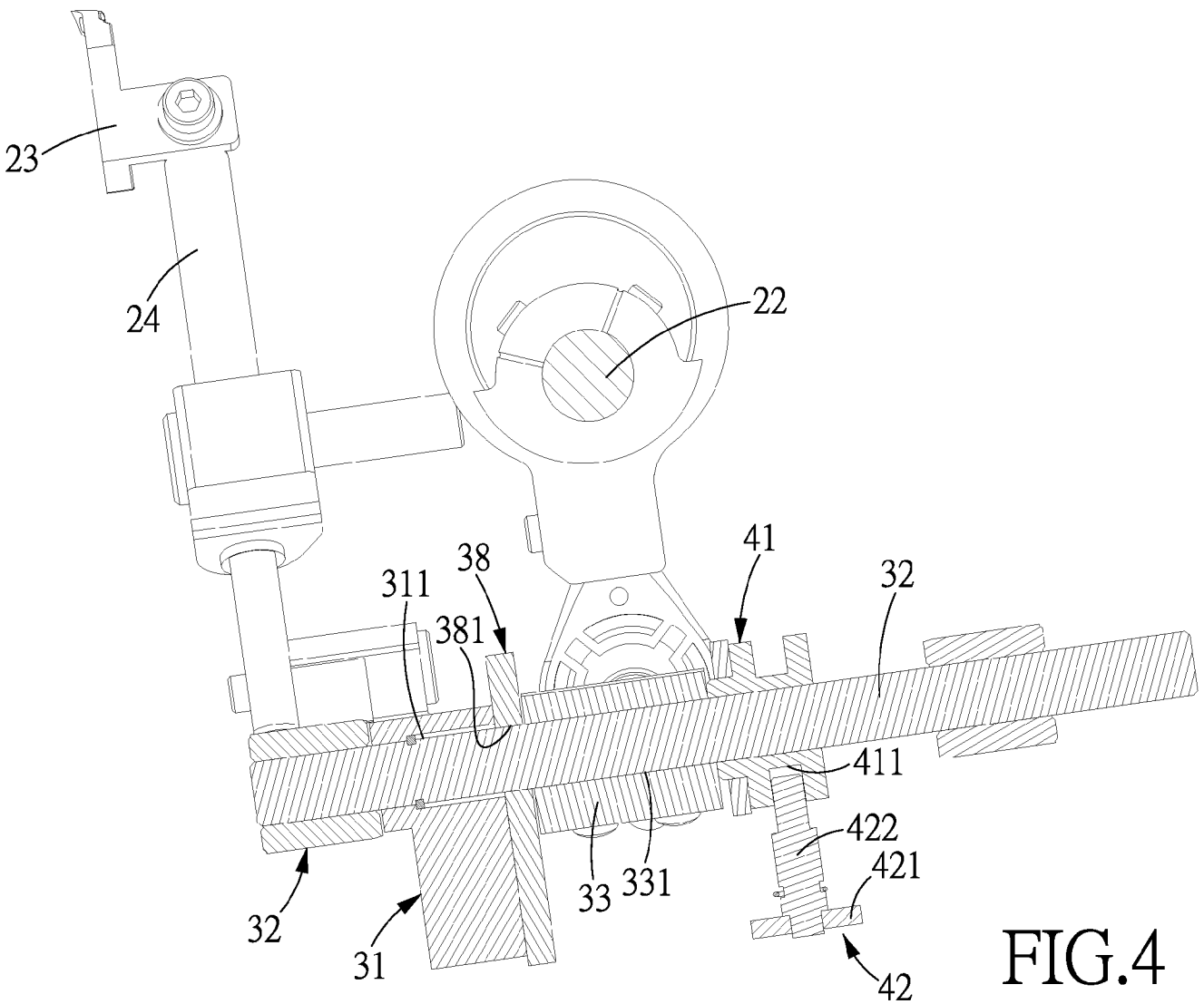
FIG. 4 is a cross sectional view taken along the line 4-4 of FIG. 3.
Figure 5:
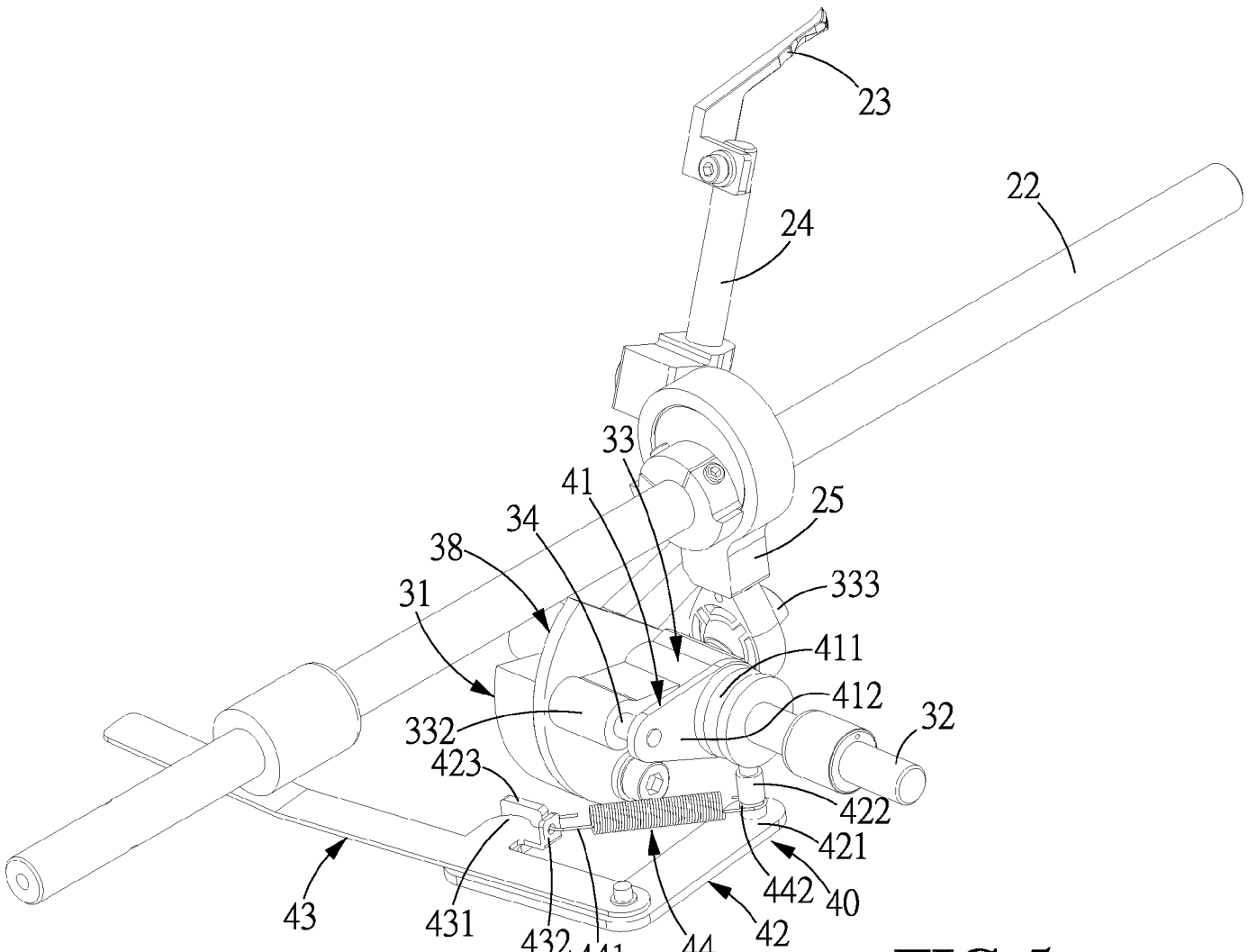
FIG. 5 is another view of the sewing machine with a drive-selection device capable of positioning an upper thread wiper when in a non-drive position in accordance with the present invention.
Figure 6:
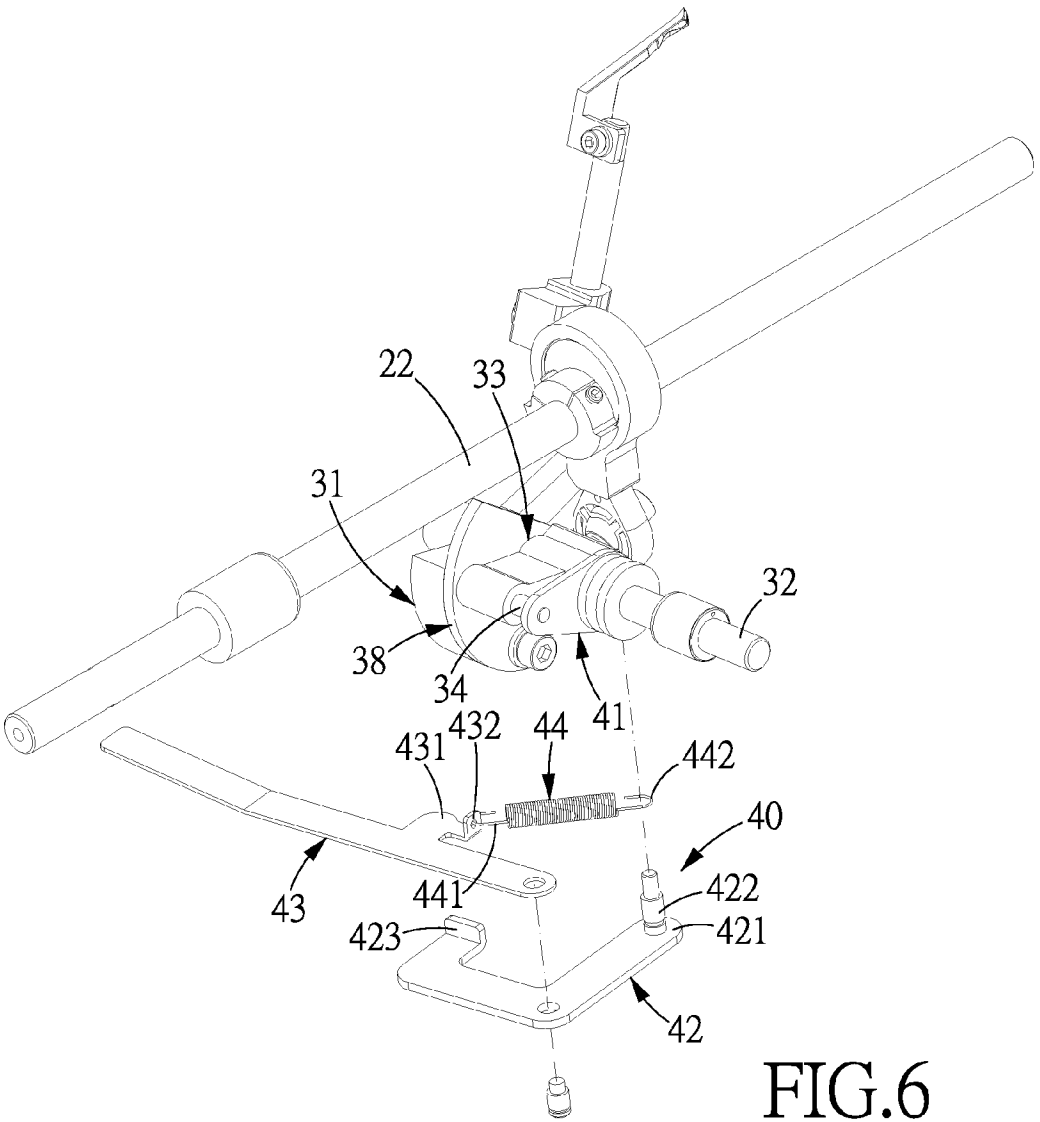
FIG. 6 is an exploded view of the sewing machine with a drive-selection device capable of positioning an upper thread wiper when in a non-drive position in accordance with the present invention.

It is to be noted that, as shown in FIGS. 7 and 8, when the stop portion 36 of the oscillating disc 38 is not aligned with the engaging portion 423 of the actuator 42, the engaging portion 423 of the actuator 42 will be restricted by the arc-shaped lateral surface 383 of the oscillating disc 38 to stop the pulling member 43 from driving the engaging portion 423 to move toward the oscillating disc 38, so that the pin 34 keeps engaging in the engaging hole 35 of the oscillating disc 38 (namely, the drive-selection device 40 is in the drive position). At this moment, the upper thread wiper 23 will be located above the needle plate 13, as shown in FIG. 1. Please refer then to FIGS. 10 and 11, when the stop portion 36 of the oscillating disc 38 is aligned with the engaging portion 423 of the actuator 42, the engaging portion 423 of the actuator 42 won't be restricted by the arc-shaped lateral surface 383 of the oscillating disc 38 any longer, so that the pulling member 43 is able to drive the engaging portion 423 to move toward the oscillating disc 38 a distance, allowing the pin 34 to disengage from the engaging hole 35 of the oscillating disc 38 (namely, the drive-selection device 40 is in a non-drive position). At this moment, the upper thread wiper 23, as shown in FIG. 2, is located below the needle plate 13, so that, when the wiper arm 24 is in the non-drive position, it can be ensured that the upper thread wiper 23 which is driven by the wiper arm 24 is located below the needle plate 13, so as to prevent the needles 14 from interfering with the upper thread wiper 23 when the needles 14 move. Hence, the upper thread wiper 23 can be assuredly positioned, when in the non-drive position.

It is to be noted that, as shown in FIGS. 9 and 12, since the oscillating disc 38 is fixed to the another end 313 of the oscillating member 31 by a bolt 37, and is provided with the stop portion 36, the engaging hole 35, and the elongated adjustment hole 382 for insertion of the bolt 37, so that the angle of the oscillating disc 38 can be adjusted and fixed. Hence, when the stop portion 36 of the oscillating disc 38 is aligned with the engaging portion 423 of the actuator 42, and the upper thread wiper 23 is not interfered with the needles 14 when the needles 14 are moving, the position of the upper thread wiper 23 with respect to the needle plate 13 and the needles 14 can be controlled.

While we have shown and described various embodiments in accordance with the present invention, it is clear to those skilled in the art that further embodiments may be made without departing from the scope of the present invention.

What is claimed is:

1. A sewing machine with a drive-selection device capable of positioning an upper thread wiper when in a non-drive position, a base of the sewing machine being provided with a mainshaft to move a wiper arm which includes an upper thread wiper, the wiper arm further including an oscillating member pivoted to a pivot which is fixed to the base, to the pivot being further pivoted a drive member, and one end of the drive member being moved back and forth by the mainshaft, the drive-selection device being provided on the base to selectively switch the drive member between a drive position and non-drive with respect to the oscillating member;

the drive-selection device including a moving member movably disposed on the pivot, an actuator for moving the moving member, and a pulling member for moving the actuator;

wherein the moving member has one end provided with the pin which extends into an insertion portion of the drive member, the oscillating member is formed with an engaging hole, and the moving member is provided with an actuating portion;

the actuator is pivoted to the base and has one end provided with an actuating end, at the actuating end is provided an actuating protrusion which engages with and moves the actuating portion, another end of the actuator is formed with an engaging portion which is pushed against by the pulling member;

the pulling member is pivoted to the base and has one side provided with a push portion which protrudes toward the engaging portion, and the pulling member is further provided with a fixing portion;

an elastic member has one end fixed to the fixing portion and another end fixed to the actuating portion of the actuating end, so as to produce a prestress to pull the fixing portion and the actuating end toward each other;

the oscillating member is provided with a stop portion;

when the stop portion is aligned with the engaging portion, the pulling member is pulled toward the oscillating member to make the push portion push against the engaging portion, so that the engaging portion is engaged with the stop portion to fix the oscillating member, and the drive-selection device is in a non-drive position.

2. The sewing machine with a drive-selection device capable of positioning the upper thread wiper when in the non-drive position as claimed in claim 1, wherein one end of the drive member is driven to move by the mainshaft via a connecting member, the drive member is formed with a pivot hole for insertion of the pivot, and another end of the drive member is formed with the insertion portion for insertion of a pin.

3. The sewing machine with a drive-selection device capable of positioning the upper thread wiper when in the non-drive position as claimed in claim 1, wherein the oscillating member is provided in a center thereof with a pivot hole for insertion of the pivot, and has one end pivoted to the wiper arm, an oscillating disc which is provided with the engaging hole and the stop portion is fixed to another end of the oscillating member by a bolt, at the center of the oscillating disc is provided an insertion hole for insertion of the pivot, and the oscillating disc is further provided with an elongated adjustment hole for insertion of the bolt, so that the angle of the oscillating disc is allowed to be adjusted and fixed.

4. The sewing machine with a drive-selection device capable of positioning the upper thread wiper when in the non-drive position as claimed in claim 1, wherein the actuating portion is an annular groove formed around the outer peripheral surface of the moving member, a pivot portion extends out of the moving member, and the pin is provided on the pivot portion and extends toward the drive member.

5. The sewing machine with a drive-selection device capable of positioning the upper thread wiper when in the non-drive position as claimed in claim 1, wherein when the pulling member is pulled to move the push portion away from the engaging portion, the actuating end of the actuator is pulled by the elastic member to make the moving member move toward the drive member, and the pin on the moving member is provided with a prestress pulling the pin toward the oscillating member, when the mainshaft drives the drove member to rotate to a position where the insertion portion is aligned with the engaging hole of the oscillating disc, the pin will be engaged in the engaging hole to drive the oscillating member and the wiper arm to move, and the drive-selection device is in a drive position.

* * * * *